US006503015B1

(12) United States Patent
Bianco, Jr.

(10) Patent No.: US 6,503,015 B1
(45) Date of Patent: Jan. 7, 2003

(54) MARKER PEN

(75) Inventor: Michael Louis Bianco, Jr., Malibu, CA (US)

(73) Assignee: Jakks Pacific, Inc., Malibu, CA (US)

( * ) Notice: Subject to any disclaimer, the term of this patent is extended or adjusted under 35 U.S.C. 154(b) by 0 days.

(21) Appl. No.: 09/944,331

(22) Filed: Aug. 30, 2001

(51) Int. Cl.[7] ..... B43K 5/00
(52) U.S. Cl. ..... 401/198; 401/199
(58) Field of Search ..... 401/198, 199, 401/196

(56) References Cited

U.S. PATENT DOCUMENTS 4,588,319 A * 5/1986 Niemeyer ..... 401/198
5,362,168 A * 11/1994 Abe et al. ..... 401/198
5,971,646 A * 10/1999 Chavatte et al. ..... 401/198
6,095,707 A * 8/2000 Kaufmann ..... 401/198
6,183,155 B1 * 2/2001 Kaufmann ..... 401/199

* cited by examiner

*Primary Examiner*—David J. Walczak
(74) *Attorney, Agent, or Firm*—Townsend and Townsend and Crew LLP

(57) ABSTRACT

A marking pen has a hollow shank 10 that supports an applicator 11 having a marking face 12. The applicator part 16 extends through a channel formed by a seal 14 into and sealingly connected to a liquid ink reservoir 13. Small air vent passages 17 and 18 provided around the applicator part 15 lead to a buffer zone 20 partially filled with porous material 21. Air may pass during use of the pen into the buffer zone but liquid ink will not flow along the passages and out of the pen. The configuration enables free liquid ink to be stored in the reservoir inside the shank.

18 Claims, 4 Drawing Sheets

MARKER PEN

BACKGROUND OF THE INVENTION

Field of the Invention

This invention relates to marking pens and more particularly to marking pens having a free liquid ink reservoir.

Marking pens are well-known and comprise an elongate applicator made of fibres or other suitable material that is rounded or otherwise shaped and at one end formed a marking face. The applicator is supported in and arranged to be exposed out of one end of a hollow shank. The other end of the applicator is supplied with ink as required. Commonly an ink supply is held in a porous pad that is retained inside the shank. Small air vent passages are provided around the applicator to allow air to pass into the shank so that ink will flow more satisfactorily from the absorbent pad into the applicator. Such arrangement of an absorbent pad reservoir is less prone to cause leakage than the use of a free liquid ink reservoir.

It is sometimes desired to have a free liquid ink reservoir in preference to an absorbent pad reservoir for various reasons; for example, it would be difficult to replenish the ink supply held in a pad or have a convenient adequate ink supply for any purposes. It has already been proposed to use a liquid ink reservoir and to provide "mechanical" valves that are automatically activated by actual use of the pen, that is when the applicator is arranged to be slidingly depressed into the shank, so that the liquid ink is retained at other times in a secondary smaller reservoir inside the shank. Such mechanical valves are disclosed in Japan Patent Specification 11334278 and U.S. Pat. No. 3,640,631, for example. Other "mechanical" means for controlling the liquid ink flow or delivery and/or any possible leakage have also been proposed, one as in United Kingdom Patent Specification 2170697. There are inherent problems in using "moving" mechanical parts especially in association with volatile liquids, such as inks, due to contamination of the valve parts. Also, the mechanical valve parts require comparatively close manufacturing and assembly tolerances for satisfactory or reliable operation.

BRIEF SUMMARY OF THE INVENTION

It is an object of the invention to overcome or at least reduce some of these problems.

According to one aspect of the invention, there is provided a marking pen having a liquid ink reservoir for containing a liquid ink and a liquid ink applicator for delivering the liquid ink from the reservoir to a marking face of the applicator in which the reservoir has an opening comprising a channel as an outlet for the liquid ink and a portion of the applicator is fittingly and fixedly disposed in the channel and co-operatively working with the channel substantially sealing the opening such that the liquid ink substantially flows out of the reservoir via the applicator.

In practice, the channel is preferably formed by a sealing means seated at the opening of the reservoir. The sealing material of the sealing means would work more efficiently with the absorbent material of the applicator in sealing the opening of the reservoir.

In accordance with a further aspect of the invention, stopping means made of material more absorbent than that of the applicator may also be provided surrounding at least an intermediate portion of the applicator.

According to another aspect of the invention, there is provided a marking pen having an elongate hollow shank with an open end, a liquid ink reservoir inside and adjacent a closed end of the shank, an applicator supported in the open end of the shank with a remote end of the applicator partially exposed out of the shank, and small aperture vent passage means extending from adjacent the remote end to a buffer zone cavity inside the shank adjacent an intermediate part of the applicator and sealed off from the reservoir such that the passage means allow air to pass into or out of the buffer zone to maintain atmospheric pressure therein. The buffer zone is preferably at least partially filled with porous material.

The applicator may comprise two end-to-end parts preferably of substantially the same length and one part conveniently extends into the reservoir through a channel, which can be formed by a seal, and may therefore be sealingly connected to the liquid ink reservoir in the shank. To achieve a more satisfactory flow of the liquid ink, the one part of the applicator may preferably have a higher porosity than the other part of the applicator.

The buffer zone preferably completely surrounds the one part of the applicator and is further filled with material that is more porous than that of the one part. The porous material in the buffer zone may comprise a strand of material wound in a spiral around the one part, and extend to lie against inner ends of the passage means.

BRIEF DESCRIPTION OF THE DRAWINGS

A marking pen according to the invention will now be described by way of example with reference to the accompanying drawings.

DETAILED DESCRIPTION OF THE INVENTION

Figure 1:
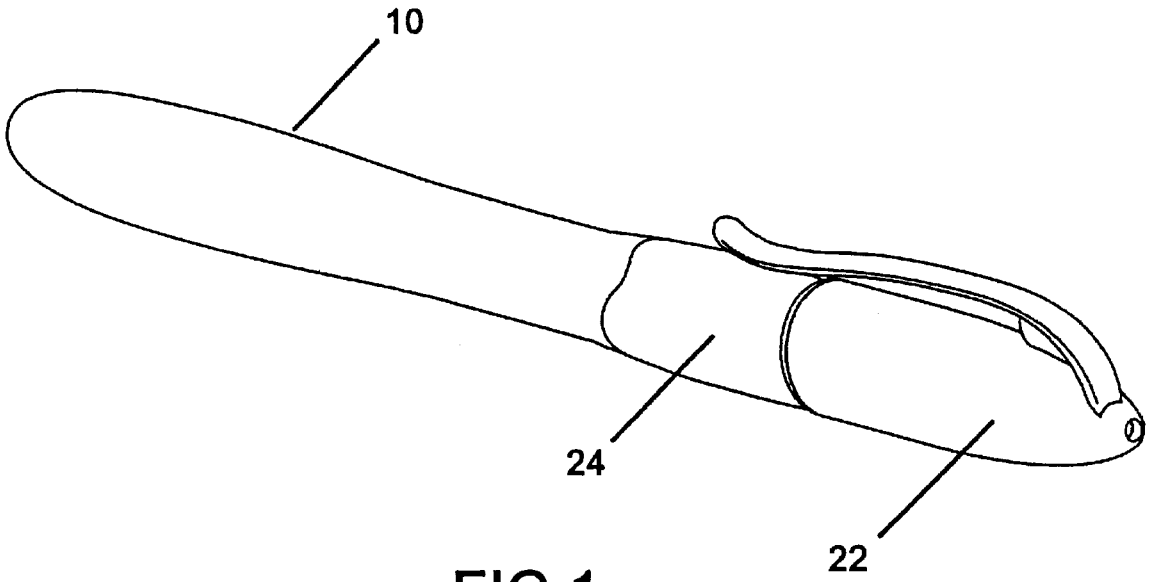
FIG. 1 shows a marking pen of the invention.
Figure 2:
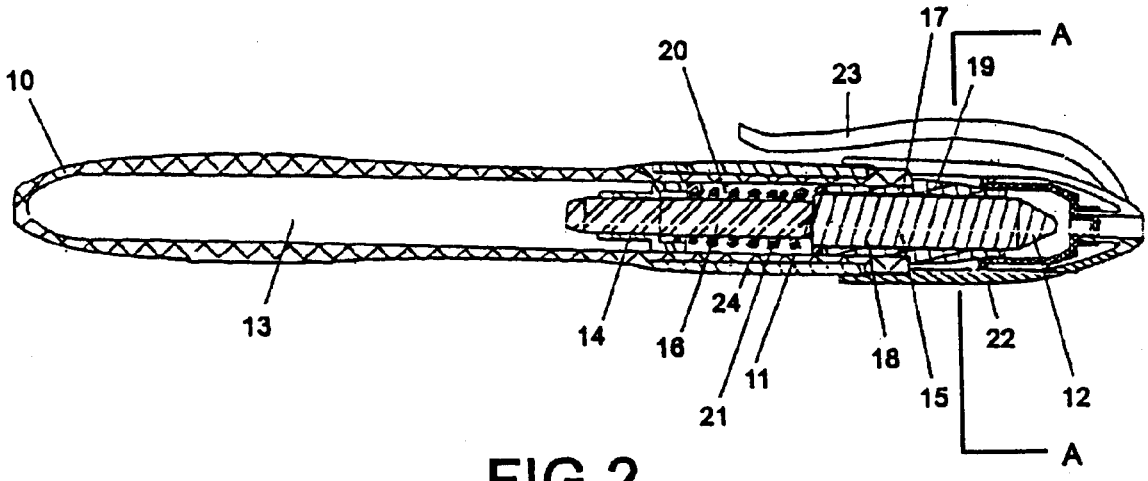
FIG. 2 shows a cross-sectional side view of the pen.

Referring to the drawings, the marking pen has a liquid ink reservoir 13 for containing a liquid ink therein and an elongate liquid ink applicator 11 made of absorbent material for delivering the ink from the reservoir to a marking face 12 of the applicator which is located adjacent an outer end of an outer part 15 of the applicator. The reservoir 13 has an opening in the form of a channel which serves as an outlet for the ink. The channel is formed by a seal 14 made of suitable sealing material and seated at the base opening of the reservoir. A portion of the applicator located adjacent an inner end of an inner part 16 of the applicator is specifically shaped to be fittingly and fixedly disposed in the channel and to co-operatively work with the channel such that the opening of the reservoir 13 is substantially sealed and the ink substantially flows out of the reservoir 13 only via the applicator. The portion of the applicator extends along the length of the channel and the inner end extends into the reservoir.

Further, an intermediate portion of the applicator 11 is surrounded by stopping means 21 made of highly absorbent porous material, more absorbent than that of the applicator 11, which would soak up any excess ink from the applicator 11 so to prevent or at least reduce any ink leakage out of the pen.

The pen also has an elongate hollow shank 10 with an open end as a casing. It supports the elongate applicator 11 that extends out of the open end of the shank and has the marking face 12 adjacent a remote end. The reservoir 13 is located inside and adjacent a closed end of the shank 10. Another end of the applicator 11 extends through the channel into the liquid ink reservoir 13 which is sealed off by the seal 14 in a base of the reservoir.

The applicator 11 is formed in two end-to-end parts, joining together the outer part 15 and the inner part 16 which are of substantially the same length. The inner applicator part 16 extends into the reservoir 13 through the channel and is sealingly and fixedly connected to the reservoir 13.

Figure 3:
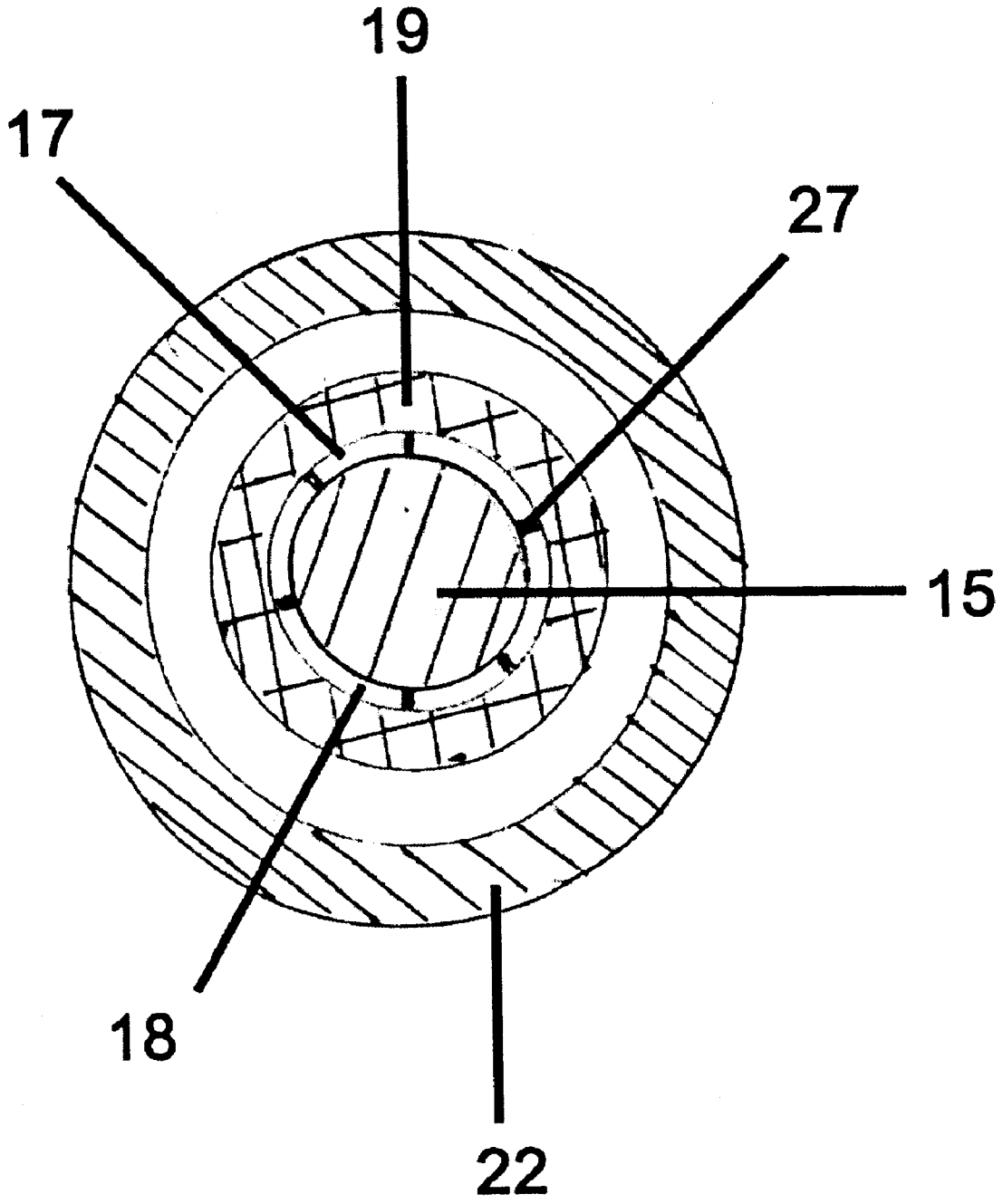
FIG. 3 shows an enlarged cross-sectional end view of the pen along the line A—A in FIG. 2.

A plurality of 'capillary' sized passages 17 and 18 are provided between the periphery of the outer part 15 and an applicator supporting nose 19. The passages are formed by a number of integral spacers or ridges 27 protruding from the inside surface of the nose 19 as more clearly shown in FIG. 3. The passages extend from the remote end of the applicator to a buffer zone cavity 20 inside the shank adjacent an intermediate part of the applicator. Such passages (known per se for other forms of marking pens that have absorbent pad reservoirs) provide 'vent passage means' to allow air to enter inside the shank as required and explained below. The nose 19 fits snugly into the end of shank 10.

The applicator 11 is fixedly held or positioned with respect to the shank 10, at near or adjacent the inner part 16 by the channel of the seal 14, and at near or adjacent the outer part 15 by the spacers 27 of the nose.

The inner applicator part 16 is formed with material that is more porous or absorbent than the outer part 15 which is for marking purpose, and it also has a cross-sectional dimension less than the outer part 15. The buffer zone 20 is formed around and completely surrounds the inner part 16 which is partially surrounded by a strand of even more porous material inside the buffer zone 20.

The pen has a cap 22 formed with a pocket slip 23. The cap fits in an airtight manner to and over the nose 19 to avoid drying out of the nib 12. A resilient plastic finger grip 24 surrounds the shank 10.

In use, liquid ink from the reservoir 13 flows into the applicator 11, inner part 16 and outer part 15, for delivery as required to the marking face 12 at the remote end. The buffer zone 20 is normally predominantly filled with air and forms a barrier between inner ends of the capillary-like passages 17 and 18 and the applicator 11. Any negative pressure that builds up inside the pen during use is relieved by airflow along the passages. In other words, the passages serve to maintain atmospheric pressure in the buffer zone 20. It can be appreciated that there is also flows or exchanges of air and ink performed by the porous material of the applicator 11 to balance the pressures between the reservoir 13 and the buffer zone 20. This means that flow of ink to the marking face 12 is not inhibited, as may otherwise be the case, as a result of build up of partial vacuums inside the pen.

Thus a form of 'valving' as described in the preferred embodiment is achieved by non-mechanical non-moving action, using a buffer zone and porous material. The valve operation would not be handicapped by inherent malfunctions as may be the case in prior art. In addition, and broadly stated, the manufacturing or assembly tolerances in providing the vent passages, buffer zone and absorbent material can be extremely wide. At the same time liquid ink can be used and the main reservoir can be re-charged with ink as required or desired.

Usually there will be little or no ink in the buffer zone 20 but any ink that flows laterally out of the applicator 11 will be absorbed by partially filling the buffer zone with the highly porous material. Preferably, the highly porous material is in the form of a strand 21 that is spirally wound around the inner part 16 and extends to wrap around the outer applicator part 15 and lie against the inner ends of the passages 17 and 18.

In practice, the marking pens of the invention using a free liquid ink reservoir would have a higher ink recovery ratio than those using an ink pad reservoir.

Figure 4:
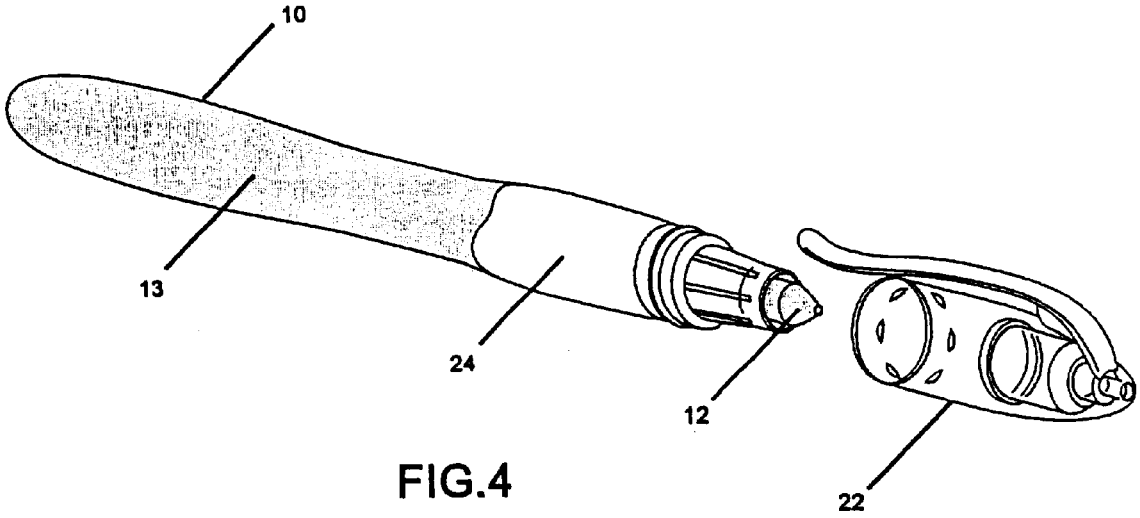
FIG. 4 shows a marking pen having casing made of transparent material.

To enhance visual appearance of the pen, casing (both shank 10 and cap 22) are made of transparent material as shown in FIG. 4 so that the colour of the ink in reservoir 13 can be seen and also the amount of ink remained in the reservoir can be seen clearly.

The scope of the invention will now be defined more clearly in the following claims.

What is claimed is:

1. A marking pen, comprising:

a liquid ink reservoir for containing a liquid ink; and a liquid ink applicator for delivering said liquid ink from the reservoir to a marking face of the applicator, wherein the applicator is elongate and comprises an inner part and an outer part joined end to end together, the inner part being made of material more absorbent than that of the outer part;

wherein said reservoir includes an opening as an outlet for said liquid ink and said opening comprising a channel, and a portion of the applicator being fittingly and fixedly disposed in said channel and co-operatively working with said channel substantially sealing said opening such that said liquid ink substantially flows out of the reservoir via the applicator.

2. A marking pen according to claim 1, wherein the inner part has a cross-sectional dimension less than that of the outer part.

3. A marking pen according to claim 1, wherein the applicator is made of absorbent material.

4. A marking pen according to claim 3, wherein the channel is formed by a sealing means seated at the opening of the reservoir, said sealing means being made of sealing material.

5. A marking pen according to claim 4, wherein stopping means are provided surrounding at least an intermediate portion of the applicator.

6. A marking pen according to claim 5, wherein the stopping means are made of material more absorbent than that of the applicator.

7. A marking pen according to claim 4, wherein the applicator is elongate and has an inner end and an outer end, said portion of the applicator disposed in the channel located adjacent said inner end.

8. A marking pen according to claim 7, wherein said marking face locates adjacent said outer end.

9. A marking pen according to claim 1, wherein stopping means made of material more absorbent than that of the inner part are provided surrounding the inner part.

10. A marking pen having a liquid ink reservoir for containing a liquid ink and an elongate liquid ink applicator made of absorbent material for delivering said liquid ink from the reservoir to a marking face of the applicator located adjacent an outer end of an outer part of the applicator, said reservoir having an opening as an outlet for said liquid ink and said opening comprising a channel, a portion of the applicator located adjacent an inner end of an inner part of the applicator being fittingly and fixedly disposed in said channel and co-operatively working with said channel substantially sealing said opening such that said liquid ink substantially flows out of the reservoir via the applicator, and an intermediate portion of the applicator surrounded by stopping means, and wherein the stopping means are made of material more absorbent than that of the applicator, and the inner part of the applicator is made of material more absorbent than that of the outer part.

11. A marking pen having an elongate hollow shank with an open end, a liquid ink reservoir inside and adjacent a closed end of the shank, an applicator supported in the open end of the shank with a remote end of the applicator partially exposed out of the shank, the applicator having one part extending into and sealingly connected to the reservoir with the one part having a higher porosity than the remote end, and small aperture vent passage means extending from adjacent the remote end to a buffer zone cavity inside the shank adjacent an intermediate part of the applicator and sealed off from the reservoir such that the passage means allow air to pass into or out of the buffer zone to maintain atmospheric pressure therein.

12. A marking pen according to claim 11, wherein the buffer zone is at least partially filled with porous material.

13. A marking pen according to claim 11, wherein the applicator comprises two end-to-end parts of substantially the same length.

14. A marking pen according to claim 11, wherein the buffer zone completely surrounds a portion of the one part of the applicator.

15. A marking pen according to claim 14, wherein the buffer zone is partially filled with material that is more porous than that of the one part.

16. A marking pen according to claim 15, wherein the porous material in the buffer zone comprises a strand of material wound in a spiral around the one part.

17. A marking pen according to claim 16, wherein the strand extends to lie against inner ends of the passage means.

18. A marking pen according to claim 11, wherein the one part of the applicator extends into the reservoir through a channel formed by a seal and is sealingly and fixedly connected with the channel.

* * * * *